United States Patent [19]

Strain

[11] Patent Number: 4,484,906

[45] Date of Patent: Nov. 27, 1984

[54] SHELL TYPE CENTRIFUGE ROTOR RETAINING RUPTURED TUBE SAMPLE

[75] Inventor: David H. Strain, Los Gatos, Calif.

[73] Assignee: Beckman Instruments, Inc., Fullerton, Calif.

[21] Appl. No.: 490,989

[22] Filed: May 2, 1983

[51] Int. Cl.[3] ..... B04B 5/02

[52] U.S. Cl. ..... 494/16

[58] Field of Search ..... 494/16, 14, 17, 19, 494/20, 21

[56] References Cited

U.S. PATENT DOCUMENTS

| | | | |
|---|---|---|---|
| 650,529 | 5/1900 | Eggeman . | |
| 1,730,776 | 10/1929 | Lundgren . | |
| 3,028,075 | 4/1962 | Blum | 494/20 |
| 3,233,825 | 2/1966 | Lomb | 233/24 |
| 4,221,325 | 9/1980 | Kubota | 233/26 |

*Primary Examiner*—Robert W. Jenkins

*Attorney, Agent, or Firm*—R. J. Steinmeyer; F. L. Mehlhoff; A. A. Canzoneri

[57] ABSTRACT

A rotor adapted for containing a plurality of sample tubes and for retaining the contents of such tubes if any should rupture while in the rotor. The rotor includes an upper shell and a lower shell connected by a central hub interposed therebetween. Provision is made for coupling the hub to a drive shaft. The upper shell has a substantially frustoconical shape and a recessed top surface. The top surface has a form generally corresponding to the interior of an inverted frustum. A plurality of sample tubes are disposed in a circular locus in the top of the rotor. The lower shell of the rotor has a bottom formed with upturned inwardly sloping conical sides. The sides are disposed such that their uppermost portion is proximate the upper shell. In the event that one or more tubes ruptures while in the rotor, the contents will be retained in the lower shell rather than spilling into the rotor chamber.

7 Claims, 2 Drawing Figures

SHELL TYPE CENTRIFUGE ROTOR RETAINING RUPTURED TUBE SAMPLE

BACKGROUND OF THE INVENTION

Shell type centrifuge rotors are generally formed as a thin wall structure comprising in effect, a hollow shell. Rotors of this kind are well-known in the centrifuge art, having been in use since the earliest centrifuges. Modern high-speed centrifuges operate in force regimes that require high-strength rotors machined from solid forgings. Current use of shell type rotors, therefore, is limited to moderate speed analytical centrifuges. Typically, centrifuges of this type are of table top size and designed to be very inexpensive compared to high performance analytical centrifuges.

In designing a centrifuge, safety is a paramount concern. In the case of the moderate speed centrifuge which is typically designed for sale in a highly competitive market, this concern for safety is closely followed by concern for economy of manufacture. Ideally, the design of the centrifuge rotor should aim not only at minimizing the fabrication cost of the rotor, but it should also contribute to every possible economy in the design of other elements of the centrifuge. One way of achieving this aim, is to simply reduce the mass of the rotor as much as practicable. In so doing, the structure of the rotor chamber can be made somewhat less rugged. In the event of a mishap to the rotor, the amount of kinetic energy that the chamber will have to safely absorb will be lower, and thus, the overall size and cost of the centrifuge can be reduced.

Another advantage to reducing the mass of the rotor is that it reduces its inertia, enabling it to be driven with less power. A smaller, less expensive motor can therefore be used. The amount of required motor power can be yet further reduced by designing the rotor so as to have low windage (i.e. aerodynamic drag).

Among other considerations relating to the design of rotors for centrifuges of the class under discussion, is a problem associated with tube breakage. This problem arises with the use of both plastic and glass sample tubes which occasionaly break under the stress of centrifugation forces. In such event, some means must be provided to prevent spillage of the tube contents into the rotor chamber. Small centrifuges typically are not equipped with seals in the rotor chamber to prevent damage to the drive system from fluids. On the contrary, many small centrifuges incorporate openings in the rotor chamber in order to utilize the air stream produced by the rotor's fan effect as a means of cooling the motor. Some designers have dealt with the problem by employing a tube adapter in which to house each sample tube. Such adapters are typically molded of plastic in a form somewhat resembling a test tube. Each adapter is designed to receive and support a sample tube, comprising in effect, a closed bottom cavity for the sample tube. While the use of such adapters adequately deals with the problem of retaining samples in the event of tube breakage, the use of adapters is generally disadvantageous because they contribute to the overall mass of the rotor and represent an additional element of cost.

Accordingly, the foregoing discussion has identified a number of problems associated with the manufacture of low-cost, moderate speed centrifuges and proposed certain design remedies therefor. The successful integration of these and certain other design features into a practical rotor is the subject of the present invention.

SUMMARY OF THE INVENTION

The present invention overcomes numerous inefficiencies of prior art rotors by providing a novel shell type centrifuge rotor. The rotor of the invention is adapted for containing a plurality of sample tubes and for retaining the contents of such tubes if any of them should rupture while in the rotor. The rotor of the present invention includes an upper shell and a lower shell connected by a central hub interposed therebetween. Means are provided for coupling the hub to suitable driving means. The upper shell has a substantially frustoconical shape including a conical portion having a rim-like extension at the bottom end thereof. The upper shell has a recessed top surface which has a form generally corresponding to the interior of an inverted frustum. A plurality of sample tubes are disposed in a circular locus in the aforesaid recessed top surface of the rotor.

The lower shell of the rotor has a bottom formed with up-turned inwardly sloping conical sides. The sides are disposed such that their uppermost portion is proximate the upper shell. Accordingly, the contents of a sample tube rupturing in the rotor are contained in the lower shell part of the rotor.

DETAILED DESCRIPTION

Figure 1:
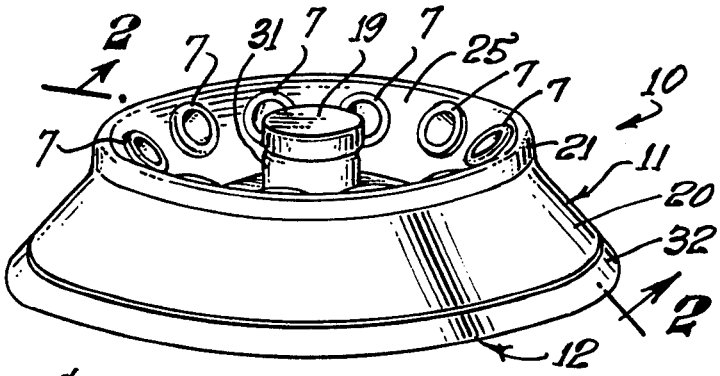
FIG. 1 is a perspective view of a rotor constructed in accordance with the invention.
Figure 2:
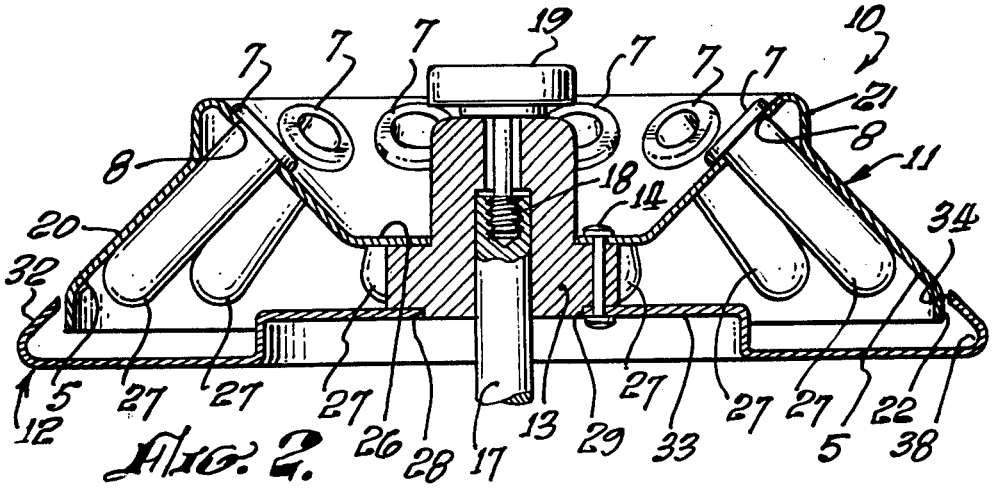
FIG. 2 is a cross-sectional view of the rotor of FIG. 1 taken on the line 2—2.

In FIG. 1 and FIG. 2 there is shown a shell type centrifuge rotor constructed in accordance with the present invention and denoted in generally by reference numeral 10. As best shown by FIG. 2, the rotor 10 has a generally frustoconical shape and is assembled from an upper shell 12 connected by a central hub 13. Fastening of the upper shell 11 and lower shell 12 to hub 13 is accomplished by using a suitable number of fasteners such as screws or rivet 14.

The upper shell is formed in a substantially frustoconical shape and includes a conical portion 20, which has a rim-like extension 21 and 22 at the top and bottom ends thereof respectively. In the preferred form, extensions 21 and 22 are made to be approximately vertical. The top surface of the upper shell 11 is recessed in a form generally corresponding to the interior of an inverted frustum. That is, the recessed top surface of upper shell 11 includes a recessed circular flat surface 26 having adjoining walls formed by conical surface 25. The conical surface 25 is provided with a plurality of apertures 8 in a circular locus, each for receiving a sample tube 27. Accordingly, each sample tube 27 inserted in an aperture 8 is supported by the tube's rim 7 which bears against conical surface 25. The sample tubes 27 may be made of glass or plastic and can be carried in the rotor without the need of tube holders or other insert cavity devices. In the rotor of the invention, the apertures 8 are located such that the centrifugal side of each tube 27 can bear against the inner wall 5 of the upper shell 11 during centrifugation. In this way, part of the centrifugal force acting on the tube is transferred to the rotor and glass tubes can be employed at higher speeds without breaking.

The hub 13 is adapted for coupling with appropriate drive means such as drive shaft 17. For this purpose, hub 13 includes a "tie-down" screw 18 for engaging screw threads provided in drive shaft 17 and thereby coupling the hub to the shaft. For convenience of operation, the tie-down screw 18 is provided with a large knurled knob 19. The hub and drive shaft may also optionally be provided with keying means to effect positive coupling thereof. Such keying means may be in the form of a key and keyway, an index pin and slot or other of the various methods known in the art and not illustrated herein.

The hub 13 is provided with a raised pilot 31 on the upper side. The pilot 31 extends through a central opening 30 in the flat surface 26 of the upper shell 11. The use of the pilot 31 makes it easy to accurately locate the upper shell with respect to the hub. In addition, the added length of the pilot increases the length of engagement between the hub and drive shaft and also positions the knob 19 of the tie-down screw at a convenient height with respect to the recessed top surface. The hub also provides a short pilot 28 on its lower side for engaging and centering the central opening 29 in the lower shell 12.

The lower shell 12 is formed to have a bottom 33 with upturned inwardly sloping conical sides 32. The uppermost part 34 of the conical sides 32 are disposed proximate, but not touching the upper shell 11 so that a narrow gap is provided therebetween. The lower shell 12 has an annular recess 35 formed in the upper side of the bottom 33. The recess 35 is contiguous with the conical sides 32 and serves to increase the volume and stiffness of the lower shell 12.

The rim-like extension 22 of the upper shell extends below the gap between the upper shell 11 and the lower shell 12. The rim-like extension 22 thereby blocks the opening provided by the gap to the interior of the rotor.

In operation, if one or more sample tubes rupture during centrifugation, the contents will be deflected downward by interior surface 5 and collect in the extreme inside corner 38 of the lower shell 12. Thus, the rim-like extension serves as a baffle preventing expulsion of the contents of the ruptured tube through the gap between upper shell 11 and lower shell 12. Through the aformentioned means, the contents of the ruptured tube is captured and retained in the rotor, rather than spilling into the centrifuge chamber. At the conclusion of centrifugation, the spilled contents may be poured out of the rotor through the gap between the upper and lower shells thereof.

In the preferred form of the invention, the upper and lower shells are formed by stamping or spinning sheet metal. It may be possible, however, to alternatively form these parts from a composite material such as a fiber reinforced resin.

It will be seen that the rotor of the invention employs a simplicity of construction which contributes materially toward reducing its weight, and, thereby, its rotating inertia. In addition, the simplicity of the rotor's construction enables the rotor to be manufactured at lower cost than prior rotors. In addition to these advantages and benefits, the rotor has low windage and retains the contents of a ruptured sample tube without the use of tube adapters or other auxiliary devices.

While in accordance with the patent statutes, there has been described what at present is considered to be a preferred embodiment of the invention, it will be understood by those skilled in the art that various changes and modifications may be made therein without departing from the invention and it is, therefore, the aim of the appended claims to cover all such changes and modifications as fall within the true spirit and scope of the invention.

What is claimed is:

1. A shell type centrifuge rotor adapted for containing a plurality of sample tubes and for retaining the contents of said sample tubes if any said tube ruptures while in said rotor, comprising:

an upper shell and a lower shell connected by a central hub interposed therebetween, said hub being adapted for coupling to a driving means;

said upper shell having a substantially frustoconical shape, including a conical portion having a rim-like extension at the bottom end thereof;

said upper shell having a recessed top surface, said top surface having a form generally corresponding to the interior of an inverted frustum;

a plurality of sample tubes disposed in a circular locus in said recessed top surface; said lower shell having a bottom with upturned inward sloping conical sides, said sides disposed so that the uppermost part thereof is proximate said upper shell.

2. The shell type centrifuge rotor defined in claim 1 wherein said rim like extension on said bottom end of said upper shell extends below the uppermost portion of said upturned conical sides of said lower shell.

3. The shell type centrifuge rotor defined in claim 1 further comprising:

said lower shell having an annular recess in the upper side of said bottom contiguous with said conical sides for increasing the volume and stiffness of said lower shell.

4. A shell type centrifuge rotor adapted for containing a plurality of sample tubes and for retaining the contents of said tubes if any said tube ruptures while in said rotor, comprising:

an upper shell and a lower shell connected by a central hub interposed therebetween; said upper shell having a substantially frustoconical shape including a conical portion having a rim-like extension at both top and bottom ends thereof;

said upper shell having a recessed top surface, said recessed top surface having a form generally corresponding to the interior of an inverted frustum;

a plurality of sample tubes disposed in a circular locus in said recessed top surface;

said lower shell having a bottom with upturned inwardly sloping conical sides, said sides disposed so that the uppermost part thereof is proximate but not touching said upper shell providing a gap therebetween;

said lower shell having an annular recess in the upper side of said bottom contiguous with said conical sides for increasing the volume and stiffness of said lower shell.

5. The shell type centrifuge rotor defined in claim 4 wherein said rim-like extension on said bottom end extends below said gap serving as a baffle for preventing the expulsion of said contents through said gap during rotation of the rotor.

6. The shell type centrifuge rotor defined in claim 4, wherein each sample tube is supported on the centrifugal side by contact with said upper shell during centrifugation.

7. A low inertia centrifuge rotor adapted for containing a plurality of sample tubes and for retaining the contents of said tubes if any said tube ruptures while in said rotor, comprising:

an upper shell and a lower shell connected by a central hub interposed therebetween, said hub being adapted for coupling to a driving means;

said upper shell having a substantially frustoconical shape including a conical portion having a rim-like extension at both top and bottom ends thereof;

said upper shell having a recessed top surface, said top surface having a form generally corresponding to the interior of an inverted frustum;

a plurality of sample tubes disposed in a circular locus in said recessed top surface;

said lower shell having a bottom with upturned inwardly sloping conical sides, said sides disposed at the uppermost portion thereof proximate but not touching said upper shell, providing a gap therebetween;

said rim-like extension on said bottom end extending below said gap serving as a baffle to prevent expulsion of said contents through said gap during rotation of said rotor;

said lower end having an annular recess formed in the upper side of said bottom contiguous with said conical sides for increasing said volume and stiffness of said lower shell;

each said sample tube being supported on the centrifugal side by contact with said upper shell during centrifugation.

* * * * *